US008520042B2

(12) United States Patent
Kawamoto

(10) Patent No.: US 8,520,042 B2
(45) Date of Patent: Aug. 27, 2013

(54) EXPOSURE APPARATUS, CONTROL METHOD THEREOF, AND IMAGE FORMING APPARATUS

(75) Inventor: Tomohiro Kawamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 13/014,284

(22) Filed: Jan. 26, 2011

(65) Prior Publication Data

US 2011/0182603 A1 Jul. 28, 2011

(30) Foreign Application Priority Data

Jan. 28, 2010 (JP) ..... 2010-017250
Jan. 14, 2011 (JP) ..... 2011-006348

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/246, 247, 236–238
See application file for complete search history.

(56) References Cited

U.S. PATENT DOCUMENTS 6,266,078 B1 * 7/2001 Koga et al. ..... 347/236
7,170,536 B2 * 1/2007 Inagawa et al. ..... 347/133
7,852,363 B2 * 12/2010 Kawamoto ..... 347/237

FOREIGN PATENT DOCUMENTS

JP 2004-284185 10/2004
JP 2009-294367 12/2009
JP 2010-046900 3/2010

* cited by examiner

*Primary Examiner* — Hai C Pham
(74) *Attorney, Agent, or Firm* — Fitzpatrick, Cella, Harper & Scinto

(57) ABSTRACT

The invention provides an exposure apparatus having a configuration such that, when a single laser light source having a plurality of light-emitting points is driven by a plurality of laser control apparatuses, mutual monitoring of the control state of the respective laser control apparatuses is possible, thus reducing malfunctions due to the effects of noise, and also provides a method to control this exposure apparatus, and an image forming apparatus. To accomplish this, the exposure apparatus does not execute light amount control of the light source to be driven when the determination unit has determined that another driving unit is causing the light source to be driven to emit light, and executes the light amount control of the light source to be driven when the determination unit has determined that another driving unit is not causing the light source to be driven to emit light.

4 Claims, 12 Drawing Sheets

FIG. 2

| CONTROL STATE | CONTROL CODE |
|---|---|
| APC CONTROL MODE (A) | 111 |
| APC CONTROL MODE (B) | 110 |
| APC CONTROL MODE (C) | 101 |
| APC CONTROL MODE (D) | 100 |
| DATA LIGHT-EMITTING MODE | 011 |
| NON-EMITTING CONTROL MODE | 000 |

FIG. 4

| CONTROL PROCEDURE | CONTROL TIME |
|---|---|
| NON-EMITTING CONTROL MODE | 10us |
| DATA LIGHT-EMITTING MODE | 300us |
| APC CONTROL MODE (A) | 5us |
| APC CONTROL MODE (B) | 5us |
| APC CONTROL MODE (C) | 5us |
| APC CONTROL MODE (D) | 10us |

FIG. 6

CONTROL PROCEDURE AND CONTROL TIMES OF LASER CONTROL APPARATUS A

| CONTROL PROCEDURE | CONTROL TIME |
|---|---|
| NON-EMITTING CONTROL MODE | 3us |
| DATA LIGHT-EMITTING MODE | 300us |
| APC CONTROL MODE (A) | 5us |
| APC CONTROL MODE (B) | 5us |
| APC CONTROL MODE (C) | 5us |
| APC CONTROL MODE (D) | 5us |
| NON-EMITTING CONTROL MODE | 30us |

CONTROL PROCEDURE AND CONTROL TIMES OF LASER CONTROL APPARATUS B

| CONTROL PROCEDURE | CONTROL TIME |
|---|---|
| APC CONTROL MODE (D) | 3us |
| DATA LIGHT-EMITTING MODE | 300us |
| NON-EMITTING CONTROL MODE | 20us |
| APC CONTROL MODE (A) | 5us |
| APC CONTROL MODE (B) | 5us |
| APC CONTROL MODE (C) | 5us |
| APC CONTROL MODE (D) | 15us |

EXPOSURE APPARATUS, CONTROL METHOD THEREOF, AND IMAGE FORMING APPARATUS

BACKGROUND OF THE INVENTION

1. Field of the Invention

The present invention relates to an exposure apparatus, a control method thereof, and an image forming apparatus.

2. Description of the Related Art

In an electrophotographic image forming apparatus, image forming is performed by forming an electrostatic latent image by an exposure apparatus irradiating light on a photosensitive drum, developing the electrostatic latent image with a development apparatus, and transferring a resulting developer image to a recording material or the like. The exposure apparatus is ordinarily provided with a laser light source that emits laser light, and a laser control apparatus that controls the laser light source. Among electrophotographic image forming apparatuses, there are image forming apparatuses that employ a laser light source having a plurality of light-emitting points (laser elements). The laser control apparatus controls the laser light source in a data light-emitting mode in which the laser light source is caused to emit light corresponding to an image signal, an APC (Auto Power Control) mode in which the strength of the laser light source is kept at a fixed level, or a non-emitting mode in which the laser light source is not caused to emit light. Japanese Patent Laid-Open No. 2004-284185 proposes technology whereby a sequence of control of a light amount of a plurality of laser elements is stored in advance, and the light-emitting point whose light amount is controlled is switched according to a switching signal that is input from outside.

However, in the above conventional technology, there are the problems described below. For example, when the above laser control apparatus is used with a plurality of such laser control apparatuses disposed in a line, the effects of noise from outside may sometimes cause a malfunction. Among image forming apparatuses, there are a plurality of models having different print speeds. For example, print speed is high in the case of an image forming apparatus for commercial printing designed for high-volume printing, and on the other hand print speed is low in the case of an image forming apparatus for small offices designed with an emphasis on conserving space.

Ordinarily, as the number of light sources provided in a laser element increases, a greater number of scan lines can be formed in a sub-scanning direction (rotational direction of a photosensitive drum) in a single scan, so increased speed of the image forming apparatus can be realized. Therefore, in an image forming apparatus having a high print speed, a laser element having a large number of light sources is used, while in an image forming apparatus having a low print speed, a laser element having a smaller number of light sources is used.

On the other hand, regarding the laser control apparatus that controls the laser element, in order to increase general applicability, one laser control apparatus is used for a laser element having a small number of light sources, and a plurality of laser control apparatuses disposed in a line are used for a laser element having a large number of light sources. In the case of a configuration in which a plurality of laser control apparatuses disposed in a line are used, it is necessary to pay attention to the combination of control states of the respective laser control apparatuses. For example, while one laser control apparatus is in an APC control mode, it is necessary for other laser control apparatuses to be in an OFF state. The reason for this is that since there is only one PD (photodetector) for a plurality of light-emitting points, when performing APC control, it is necessary to perform control such that only laser light of the light-emitting point subject to APC control is incident on the PD.

However, according to the conventional technology, there is the problem that when noise is included in a light amount switching signal that is input to one laser control apparatus, the control procedures of the laser control apparatuses do not transition at an intended timing relative to each other, so a malfunction occurs in an image forming operation. For example, a situation also occurs in which two laser control apparatuses are simultaneously in the APC control mode. Here, there is the problem that APC control is not properly performed, so it is not possible to suppress degradation of a laser element.

SUMMARY OF THE INVENTION

The present invention enables realization of an exposure apparatus configured such that, when using a plurality of laser control apparatuses to drive a single laser light source having a plurality of light-emitting points, the respective laser control apparatuses can monitor a control state of each other, thereby reducing malfunctions due to the effects of noise. The present invention also enables realization of a method for controlling such an exposure apparatus, and realization of an image forming apparatus.

According to one aspect of the present invention, there is provided an exposure apparatus, comprising: a plurality of light sources that emit a light beam; a detection unit that detects light beams emitted from the plurality of light sources; and a plurality of driving units that drive respectively differing light sources among the plurality of light sources, wherein each driving unit causes any one of the plurality of light sources to emit light, and executes light amount control in which control is performed based on a light amount of a light beam detected by the detection unit such that the light amount of the light beam emitted from that light source becomes a predetermined light amount; and a determination unit that, when the plurality of driving units each execute the light amount control of a light source to be driven, determines whether or not another driving unit is causing the light source to emit light, wherein each of the plurality of driving units does not execute the light amount control of the light source to be driven when the determination unit has determined that another driving unit is causing the light source to be driven to emit light, and executes the light amount control of the light source to be driven when the determination unit has determined that another driving unit is not causing the light source to be driven to emit light.

According to another aspect of the present invention, there is provided an image forming apparatus, comprising: the exposure apparatus mentioned above.

According to still another aspect of the present invention, there is provided a method for controlling an exposure apparatus, the exposure apparatus comprising: a plurality of light sources that emit a light beam; a detection unit that detects light beams emitted from the plurality of light sources; and a plurality of driving units that drive respectively differing light sources among the plurality of light sources, wherein each driving unit causes any one of the plurality of light sources to emit light, and executes light amount control in which control is performed based on a light amount of a light beam detected by the detection unit such that the light amount of the light beam emitted from that light source becomes a predetermined light amount; the method comprising: when the plurality of driving units each execute the light amount control of a light source to be driven, determining whether or not another driving unit is causing the light source to emit light; and each of the plurality of driving units not executing the light amount control of the light source to be driven when determined that another driving unit is causing the light source to be driven to emit light, and executing the light amount control of the light source to be driven when determined that another driving unit is not causing the light source to be driven to emit light.

Further features of the present invention will be apparent from the following description of exemplary embodiments with reference to the attached drawings.

BRIEF DESCRIPTION OF THE DRAWINGS

FIG. 2 shows 3-bit control codes assigned to light source control states according to the first embodiment.

FIG. 4 shows a control procedure and control times that have been stored in a storage unit 233 according to the first embodiment.

FIG. 6 shows a control procedure and control times that have been stored in the storage unit 233 according to the first embodiment.

DESCRIPTION OF THE EMBODIMENTS

Figure 1:
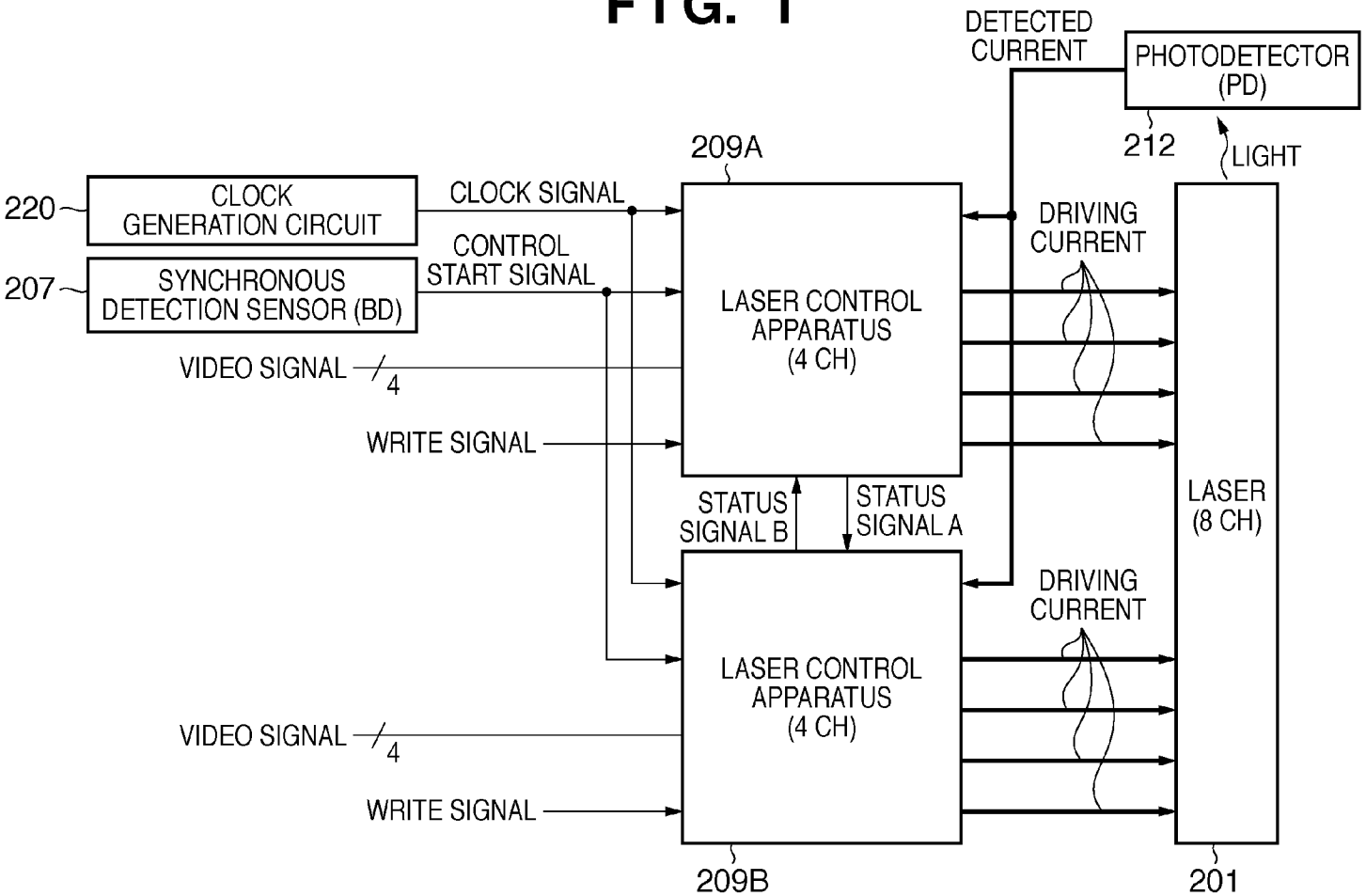
FIG. 1 shows an example configuration of laser control according to a first embodiment.

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

Configuration of Image Forming Apparatus

Following is a description of a first embodiment, with reference to FIGS. 1 to 10. First is a description of an example configuration of an image forming apparatus with reference to FIG. 8. Below, the image forming apparatus is described as an example of an apparatus to which the present invention is applied. However, the present invention is not limited to an image forming apparatus, and is also applicable to any apparatus having an exposure apparatus as described later. An image forming apparatus 100 includes an original feed apparatus 1, an original stage glass 2, a scanner lamp 3, a scanner unit 4, mirrors 5, 6, and 7, a lens 8, an image sensor unit 9, an exposure apparatus 10, a charging unit 12, a photosensitive body 11, a development unit 13, recording material loading units 14 and 15, a transfer unit 16, a fixing unit 17, a discharge unit 18, and a display unit 19.

The original feed apparatus 1 feeds a plurality of pages of an original that have been loaded to the original stage glass 2 page-by-page. Light is irradiated by the scanner lamp 3 onto the original that has been fed to the original stage glass 2, reflected light from the original is reflected by the mirror 5 of the scanner unit 4, and that reflected light forms an image on the image sensor unit 9 via the mirrors 6 and 7 and the lens 8. The exposure apparatus 10 irradiates light onto the photosensitive body 11 according to image data, forming an electrostatic latent image. Here, the charging unit 12 uniformly charges the surface of the photosensitive body 11.

The electrostatic latent image formed on the photosensitive body 11 is developed by the development unit 13, and transferred to recording material that has been transported from the recording material loading units 14 and 15 by the transfer unit 16. The recording material on which a developer image has been transferred is transported to the fixing unit 17, where the developer image is fixed to the recording material, and then discharged outside of the image forming apparatus 100 in the discharge unit 18. Also, the display unit 19 is a user interface, and is provided with a touch panel-type display unit and an operation unit.

Image Forming Operation

Figure 9:
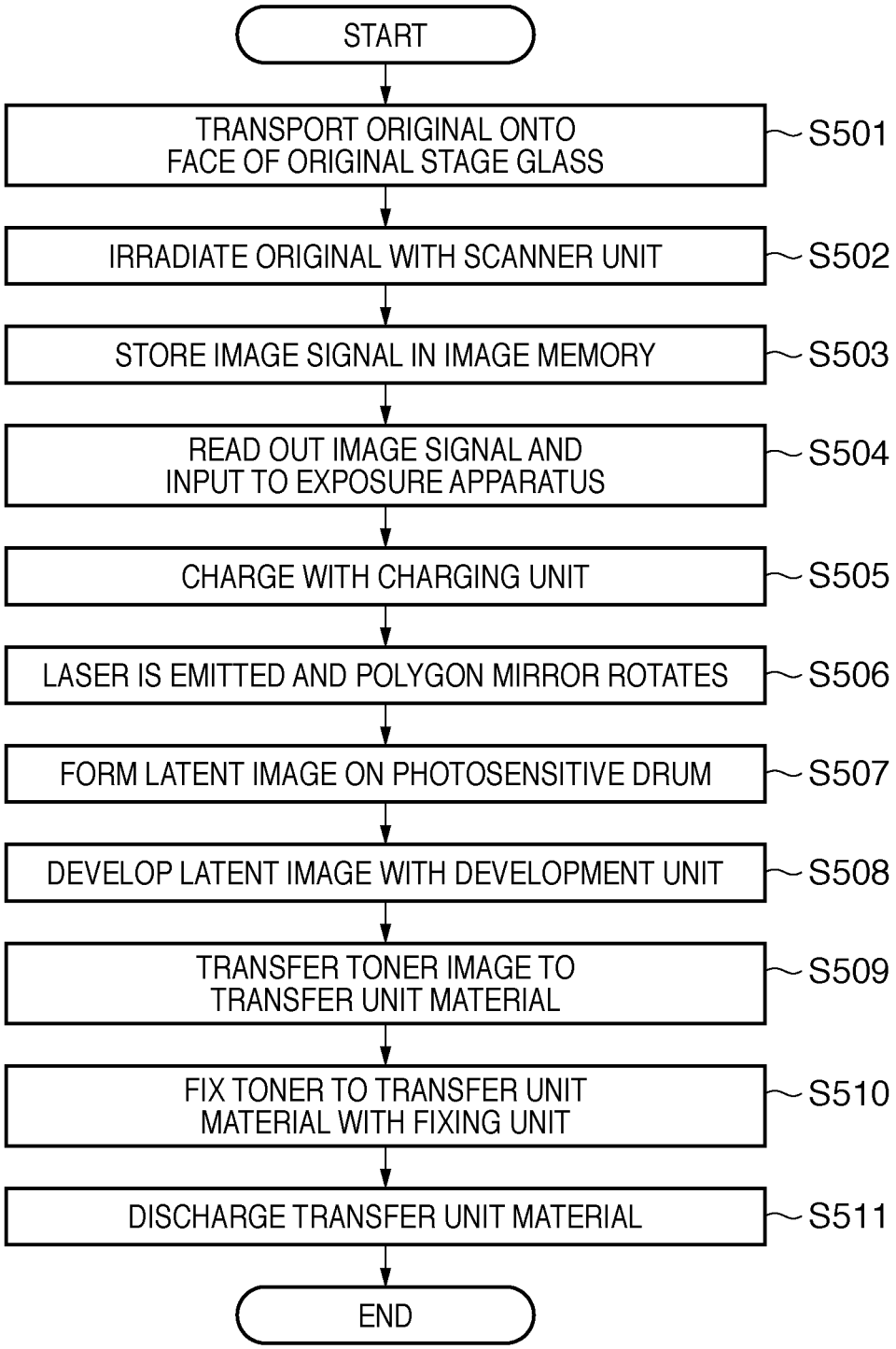
FIG. 9 is a flowchart that shows a basic operation procedure of the image forming apparatus 100 according to the first embodiment.

Next is a detailed description of an image forming operation of the image forming apparatus 100, with reference to FIG. 9. In step S501, an original that has been loaded on the original feed apparatus 1 is sequentially transported page-by-page onto the face of the original stage glass 2. When the original is transported, in step S502, the scanner lamp 3 emits light and the scanner unit 4 moves to irradiate the original. Here, the reflected light of the original passes through the lens 8 via the mirrors 5, 6, and 7 and then is input to the image sensor unit 9. Next, in step S503, an image signal that has been input to the image sensor unit 9 is directly input to the exposure apparatus 10, or is temporarily stored in an unshown image memory, again read out in step S504, and then input to the exposure apparatus 10.

Next, in step S505, the charging unit 12 uniformly charges the photosensitive body 11. Then, in step S506, the exposure apparatus 10 emits light from a laser element provided within the exposure apparatus 10 according to the image signal, the light is deflected with an unshown polygon mirror that rotates, and thus laser light is scanned on the photosensitive body 11. Thus, in step S507 an electrostatic latent image is formed on the photosensitive body 11. Next, in step S508, the development unit 13 develops the electrostatic latent image that has been formed into a visible image.

In step S509, the recording material loading units 14 and 15 transport recording material at a timing coordinated with development of the electrostatic latent image, and in the transfer unit 16, the visible image that has been developed is transferred onto the recording material. In step S510, the visible image that has been transferred is fixed to the recording material by the fixing unit 17, and in step S511 this recording material is discharged outside of the apparatus by the discharge unit 18. By repeating this process, the image forming apparatus 100 performs image forming of a plurality of pages.

FIG. 9 shows an example in which an image is formed on recording material based on image data obtained by reading an original transported onto the original stage glass 2, but other embodiments are also possible. For example, an embodiment may also be adopted in which image data sent from an external information processing apparatus such as a PC is received, and an image is formed on recording material based on the received image data.

Configuration of Exposure Apparatus

Figure 10:
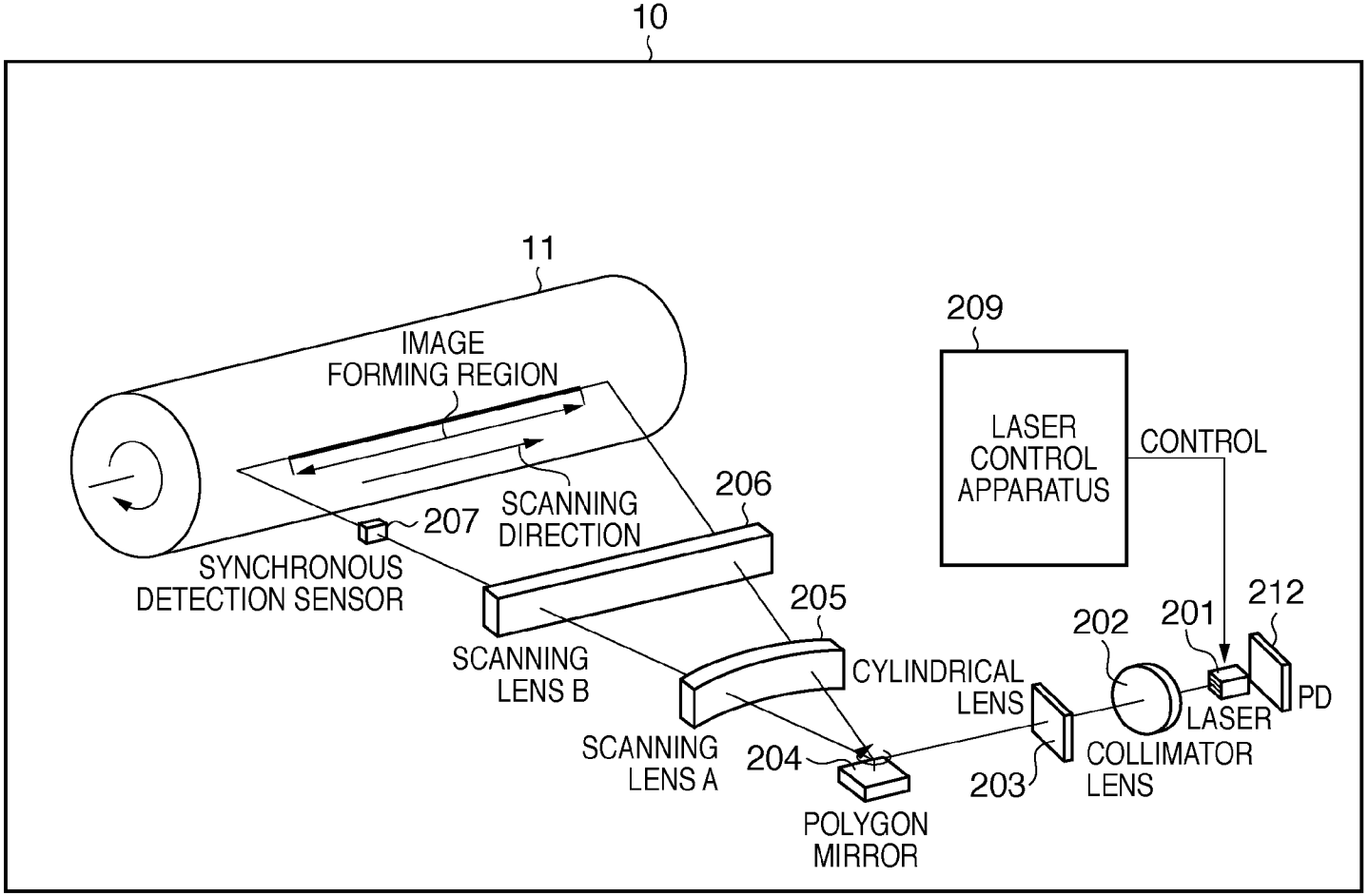
FIG. 10 shows an example configuration of an exposure apparatus 10 according to the first embodiment.

Next is a description of an example configuration of the exposure apparatus 10, with reference to FIG. 10. The exposure apparatus 10 includes a laser light source 201, a photodetector 212 (referred to below as a PD), a collimator lens 202, a cylindrical lens 203, a polygon mirror (rotating multi-face mirror) 204, a scanning lens A 205, a scanning lens B 206, a synchronous detection sensor 207, and a laser control apparatus 209.

The laser light source 201 includes a plurality of light sources (light-emitting points), and emits laser light from each light source. The PD 212 is a sensor for detecting the strength of laser light, and is disposed at a position where the laser light emitted from the plurality of light sources is incident. The collimator lens 202 shapes the laser light into parallel light. The cylindrical lens 203 condenses light that has passed through the collimator lens 202 in the sub-scanning direction. The polygon mirror 204 rotates at high speed and deflects the laser light.

The scanning lens A 205 and the scanning lens B 206 perform correction so as to keep the deflected laser light (scanning light) at a fixed speed. The synchronous detection sensor 207 detects the scanning light and outputs a horizontal synchronous signal. The laser control apparatus 209 controls the laser light source 201. The laser control apparatus 209 controls the laser light source 201 in a data light-emitting mode in which the laser light source is caused to emit light corresponding to an image signal, an APC (Auto Power Control) mode (light amount adjusting mode) in which the strength (light amount) of the laser light source 201 is adjusted to a fixed level, or a non-emitting mode in which the laser light source 201 is not caused to emit light.

Laser Control

Next is a description of a configuration related to laser control in the present embodiment, with reference to FIG. 1. As shown in FIG. 1, the laser light source 201 includes eight light sources (light sources A, B, C, D, E, F, G, and H). The image forming apparatus 100 includes the photodetector (PD) 212 that detects laser light, laser control apparatuses 209A and 209B that respectively drive four different light sources among the eight light sources, a clock generation circuit 220 that causes generation of pulses of a fixed period, and the synchronous detection sensor (BD) 207. Thus, in the image forming apparatus 100 according to the present embodiment, the plurality of laser light sources (A to H) are controlled in a distributed manner by the plurality of laser control apparatuses (209A and 209B) that are driving units.

The laser control apparatuses 209A and 209B each drive four light sources. Also, the laser control apparatuses 209A and 209B control control information that indicates a control state of the laser light source 201 to any of the data light-emitting mode, an APC control mode (A), an APC control mode (B), an APC control mode (C), an APC control mode (D), and a non-emitting control mode. The above APC is control performed in a non-image region. An "image region" refers to a scanning region where laser light is scanned in order to form an image based on input image data, a toner pattern for density correction, and a registration pattern for color shift correction. A "non-image region" refers to a region other than the image region within the region where laser light is scanned. The APC is performed in a period when the laser light is scanning the non-image region. Which of the image region and the non-image region the laser light is scanning can be determined from a signal output from the synchronous detection sensor 207 and a clock signal, described later.

The data light-emitting mode is a mode in which all four light sources are controlled in the data light-emitting mode. That is, laser light is emitted from each light source based on input image data. The APC control mode (A) is a (APC control) mode in which one light source among the four light sources is caused to emit light, and driving current supplied to that light source is controlled such that a light amount of the light source becomes a predetermined light amount based on the light amount of laser light that is incident on the PD at that time. The APC control mode (B), the APC control mode (C), and the APC control mode (D) similarly are modes in which APC control of one light source among the four light sources is performed. The non-emitting control mode is a mode in which all four light sources are caused to not emit light. A 3-bit control code is assigned to each control, as shown in FIG. 2. For example, the control code of the data light-emitting mode is 011.

The synchronous detection sensor (BD) 207 outputs a signal (control start signal) in the form of a pulse when laser light has crossed above the sensor. A control start signal that has been output from the synchronous detection sensor (BD) 207 is branched and then is input to the laser control apparatuses 209A and 209B. Also, according to the present embodiment, a clock signal that has been generated by the clock generation circuit 220 is branched and then is input to the laser control apparatuses 209A and 209B. By adopting such a configuration, in comparison to a case of providing a clock generation circuit for each of the laser control apparatuses 209A and 209B, it is possible to synchronize the transition timing of control information in the respective laser control apparatuses 209A and 209B. Furthermore, it is not necessary to provide a clock generation circuit for each laser control apparatus, so cost can be reduced.

When the control start signal that has been output from the synchronous detection sensor (BD) 207 is input, the laser control apparatuses 209A and 209B start control of the laser light source 201. When control is started, the laser control apparatuses 209A and 209B sequentially switch the control information of the laser light source 201 according to the clock signal that has been input from the clock generation circuit 220. Also, four video signals that correspond to the four light sources are input to the laser control apparatuses 209A and 209B respectively. When the laser control apparatus 209A is in the data light-emitting mode, when the video signal that corresponds to the laser light source A is input to the laser control apparatus 209A, the laser control apparatus 209A generates a predetermined driving current for the laser light source A.

Also, a detected current is input from the photodetector (PD) 212 to the laser control apparatuses 209A and 209B. When the laser control apparatus 209A is in the APC control mode for the laser light source A, first, the laser control apparatus 209A causes the laser light source A to emit light. Then, due to light that has been emitted from the laser light source A being irradiated onto the photodetector (PD) 212, detected current is generated by the photodetector (PD) 212, and that current is input to the laser control apparatus 209A. The laser control apparatus 209A performs light amount control by increasing or decreasing the driving current for the laser light source A such that the detected current becomes a target value that has been set in advance.

Also, the laser control apparatus 209A outputs a status signal A that is a signal indicating the control state (control information) of the laser control apparatus 209A to the laser control apparatus 209B. The status signal A is a signal that expresses the control information of the laser control apparatus 209A, and is output with an analog voltage signal obtained by performing D/A conversion of the control code. For example, when the control information of the laser control apparatus 209A indicates the data light-emitting mode, the control code for that mode is 011 (3 in decimal notation), so the voltage signal that is output is 5V (power supply voltage)× 3/7=2.1V.

Likewise, the laser control apparatus 209B outputs a status signal B to the laser control apparatus 209A. The status signal B likewise is a signal that expresses the control information of the laser control apparatus 209B, and is output with an analog voltage signal obtained by performing D/A conversion of the control code. That is, the laser control apparatuses 209A and 209B monitor the control information of each other.

Configuration of Laser Control Apparatus

Figure 3:
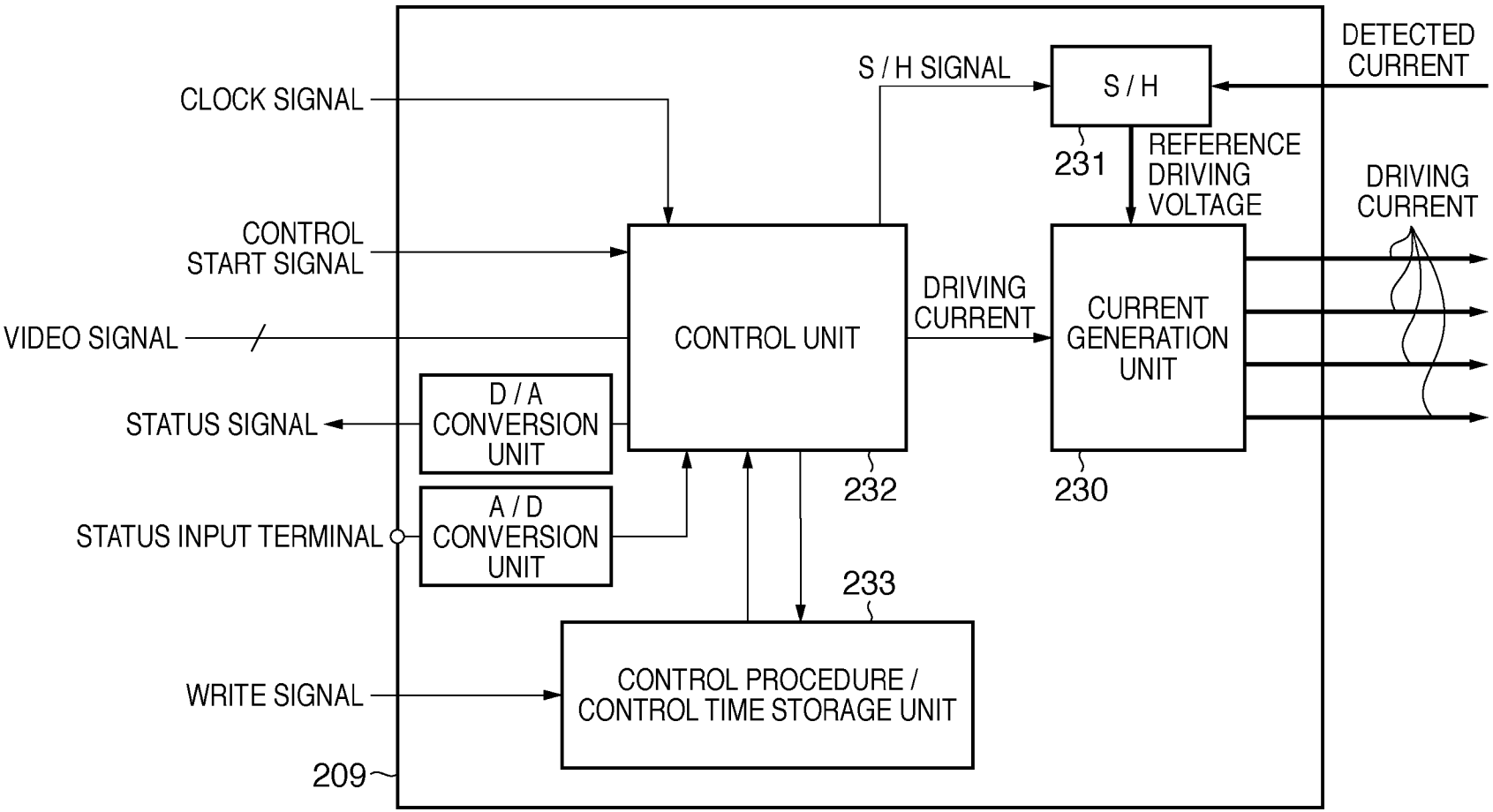
FIG. 3 shows an example of an internal circuit of a laser control apparatus 209 according to the first embodiment.

Next is a description of an internal circuit of a laser control apparatus 209 serving as a driving unit in the present embodiment, with reference to FIG. 3. The laser control apparatuses 209A and 209B have the configuration described below. Accordingly, in the description given here those are abbreviated to the laser control apparatus 209.

The laser control apparatus 209 includes a current generation unit 230, an S/H circuit 231, a storage unit 233, and a control unit 232. The current generation unit 230 generates a driving current for each of the four laser light sources. The S/H circuit 231 converts the detected current from the photodetector (PD) 212 to a voltage, and samples and holds that voltage. The storage unit 233 can be written to from outside, and stores a control procedure of the laser control apparatus 209 and a control time in each control.

When the control start signal that has been output from the synchronous detection sensor (BD) 207 is input, the control unit 232 operates according to the control procedure and the control time that are stored in the storage unit 233. For example, the control procedure (control procedure) and the control time (execution time information) shown in FIG. 4 are stored in the storage unit 233.

When a control start signal is input, the control unit 232 first executes the non-emitting control mode for a time of 10 us. Next, the control unit 232 executes the data light-emitting mode for 300 us. Next, the control unit 232 executes the APC mode (A) for 5 us. The APC mode (A) is a mode in which APC control is performed for the light source A among the four light sources (A, B, C, and D) provided in the laser light source 201. Next, the control unit 232 executes the APC mode (B) that is APC control for the light source B for 5 us. Next, the control unit 232 executes the APC mode (C) that is APC control for the light source C for 5 us. Next, the control unit 232 executes the APC mode (D) that is APC control for the light source D for 10 us. With the above sequence, one sequence of control that is stored in the storage unit 233 is executed.

Next is a description of operation when the laser control apparatus 209 controls the laser light source 201A in the APC control mode (A). When the laser control apparatus 209 is set to the APC control mode (A), the control unit 232 outputs a driving signal to the current generation unit 230. The current generation unit 230 applies the driving current to the laser light source 201A, thus causing the laser light source 201A to emit light. Then, the light that has been emitted from the laser light source 201A is incident on the photodetector (PD) 212, detected current from the photodetector (PD) 212 is generated, and a signal obtained by converting that current to a voltage is input to the S/H circuit 231. The current generation unit 230 increases or decreases the driving current until the detected current input to the S/H circuit 231 becomes a target value that has been set in advance. When the detected current input to the S/H circuit 231 becomes the target value, the control unit 232 outputs a hold signal to the S/H circuit 231, and the driving voltage at that time is held in the S/H circuit 231.

Next is a description of operation when the laser control apparatus 209 controls the laser light source 201A in the data light-emitting mode. When the laser control apparatus 209 is set to the data light-emitting mode and a video signal of the laser light source A is input, the control unit 232 outputs a driving signal to the current generation unit 230 with a light-emitting pattern according to the video signal. The current generation unit 230 generates a predetermined driving current with a light-emitting pattern according to the driving signal for the laser light source A.

Next, is a description of operation when the laser control apparatus 209 controls the laser light source 201A in the non-emitting mode. When the laser control apparatus 209 is set to the non-emitting mode, the control unit 232 performs control such that a driving signal is not output to the current generation unit 230. As a result, the current generation unit 230 does not generate a driving current for the laser light source A, so the laser light source A is set to a non-emitting state (a state in which laser light is not emitted). Also, while the laser control apparatus 209 is set to the non-emitting mode, even if a video signal has been input to the laser control apparatus 209, the control unit 232 does not output a driving signal to the current generation unit 230 (the laser light source is not set to a light-emitting state).

Also, the laser control apparatus 209 outputs a status signal (control information) that expresses the control state of the laser control apparatus 209. As described above, the status signal is a signal that expresses the control information of the laser control apparatus 209, and is output with an analog voltage obtained by performing D/A conversion of the control code. For example, when the control information of the laser control apparatus 209 indicates the data light-emitting mode, the control code for that mode is 011 (3 in decimal notation), so the voltage signal that is output is 5V (power supply voltage)×3/7=2.1V.

As described above, by adopting a configuration in which a status signal expressed with a voltage level is output from a single terminal, it is possible to reduce the number of output terminals provided in the laser control apparatus. Also, in the laser control apparatus 209, a terminal for inputting a status signal is provided, so it is made possible to monitor the control information of another laser control apparatus.

As described above, the APC control is necessary in order to cause the laser light sources to emit light one-by-one, so while a particular laser control apparatus is performing APC control, another laser control apparatus cannot perform APC control. In the present embodiment, by adopting a configuration in which a status signal that has been output by the other laser control apparatus is input to a status input terminal of the particular laser control apparatus, and A/D conversion of that signal is performed, it is possible to monitor the control information of the other laser control apparatus. Based on the result of detecting the control information of the other laser control apparatus, the laser control apparatus 209 performs control such that the laser control apparatus 209 does not perform APC control while another laser control apparatus is performing APC control. With this function, it is possible to suppress the occurrence of a plurality of laser control apparatuses simultaneously being in the APC control mode, and so it is possible to suppress degradation of a laser element.

Operation of Laser Control Apparatus

Figure 5:
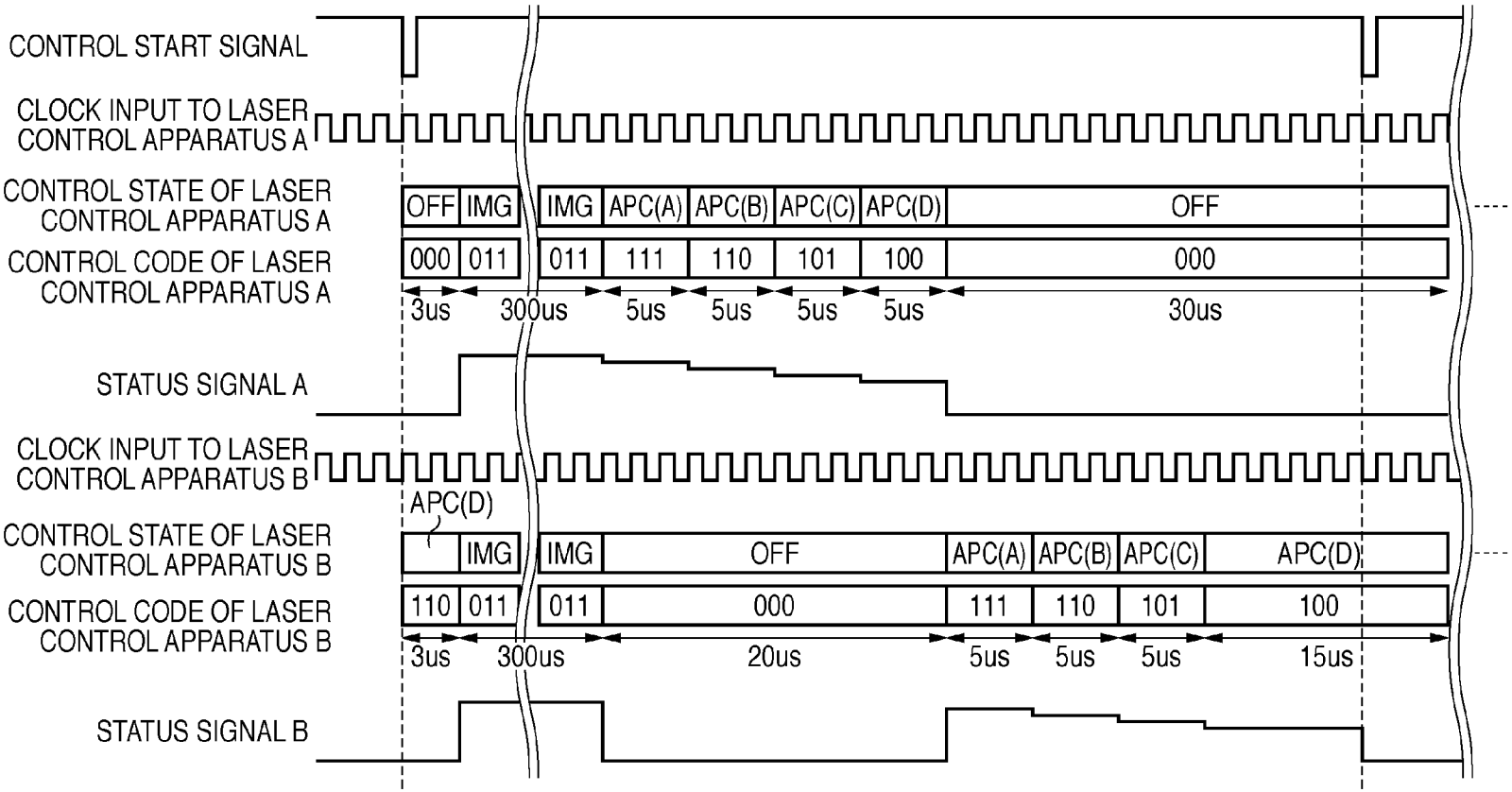
FIG. 5 shows an operation sequence of the laser control apparatus 209 according to the first embodiment.

Next is a description of operation of a laser control apparatus, with reference to FIGS. 1, 5, and 6. A control procedure and control times as shown in FIG. 6 are assumed to be stored in the respective storage units provided in the laser control apparatus 209A and the laser control apparatus 209B. FIG. 5 shows the operation sequence of the laser control apparatus 209A and the laser control apparatus 209B in the configuration shown in FIG. 1.

When the control start signal that has been output from the synchronous detection sensor (BD) 207 is input to the laser control apparatus 209A and the laser control apparatus 209B, the laser control apparatus 209A and the laser control apparatus 209B start operation in synchronization with the clock. The laser control apparatus 209A first executes the non-emitting control mode for 3 us according to the control procedure and the control times shown in FIG. 6. On the other hand, the laser control apparatus 209B first executes the APC control mode (D) for 3 us according to the control procedure and the control times shown in FIG. 6.

Next, the laser control apparatus 209A executes the data light-emitting mode for 300 us. On the other hand, the laser control apparatus 209B also executes the data light-emitting mode for 300 us. Next, the laser control apparatus 209A executes the APC control mode (A) for 5 us, then executes the APC control mode (B) for 5 us, then executes the APC control mode (C) for 5 us, then executes the APC control mode (D) for 5 us. During this execution of APC control modes, the laser control apparatus 209B executes the non-emitting control mode for 20 us.

Next, the laser control apparatus 209A executes the non-emitting control mode for 30 us. During this execution of the non-emitting control mode, the laser control apparatus 209B executes the APC control mode (A) for 5 us, then executes the APC control mode (B) for 5 us, then executes the APC control mode (C) for 5 us, then executes the APC control mode (D) for 15 us. With the above operation, one sequence of control by the laser control apparatus 209A and the laser control apparatus 209B is executed.

Operation of Laser Control Apparatus When Noise is Mixed In

Figure 7:
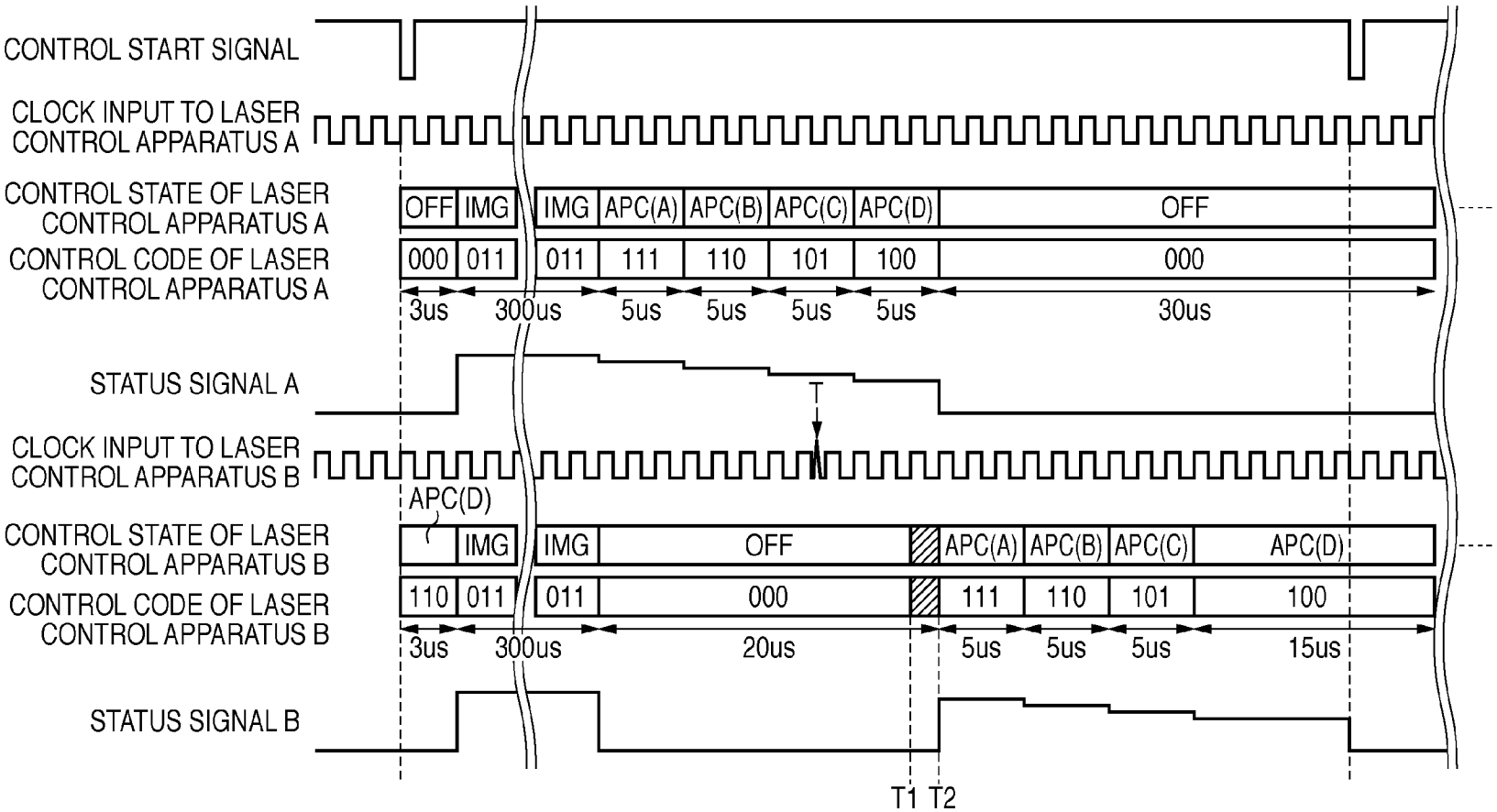
FIG. 7 shows an operation sequence of a laser control apparatus 209A and a laser control apparatus 209B when noise has been mixed into a clock of the laser control apparatus 209B according to the first embodiment.
Figure 8:
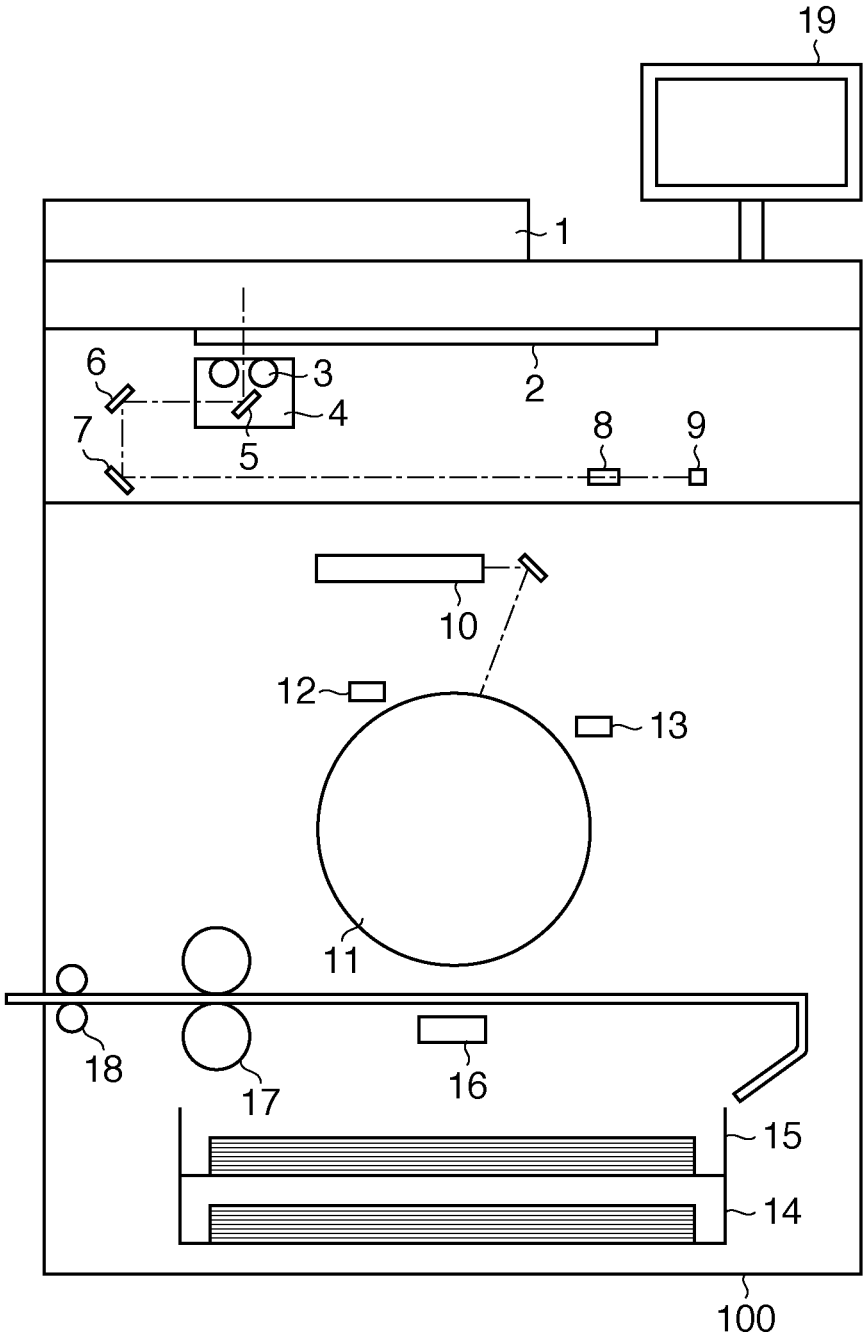
FIG. 8 shows an example configuration of an image forming apparatus 100 according to a first embodiment.

Next is a description of operation of the laser control apparatus 209A and the laser control apparatus 209B when noise is mixed into the clock of the laser control apparatus 209B, with reference to FIG. 7.

In the present embodiment, it is assumed that noise is mixed in at a time T, and the laser control apparatus 209B mistakenly recognized a starting edge of the noise as a clock signal. Thus, for the laser control apparatus 209B, state transition timing is one clock earlier than normal. Normally, the APC (A) is expected to start at a time T2, but because the state transition timing is one clock earlier than normal, the APC (A) is started at time T1. Thus, a situation occurs in which timing overlaps the APC (D) of the laser control apparatus 209A.

However, with the image forming apparatus 100 according to the present embodiment, the laser control apparatus 209B is monitoring the status of the laser control apparatus 209A. Accordingly, at time T1, even if the laser control apparatus 209B attempts to start the APC (A), at that time it is possible to recognize that the laser control apparatus 209A is performing the APC (D). Thus, the laser control apparatus 209B adopts a standby state (maintaining the present OFF state) until the laser control apparatus 209A finishes the APC (D), and can start the APC (A) after the laser control apparatus 209A finishes the APC (D).

That is, while the laser control apparatus 209A is executing the APC (while in the light amount adjusting mode), even if the timing for starting APC execution has been reached, the laser control apparatus 209B delays the timing for starting APC execution. Afterward, the laser control apparatus 209B starts the delayed APC execution when the laser control apparatus 209A has transitioned from the light amount adjusting mode to another mode. When delaying the APC execution, the laser control apparatus 209B maintains the present control information as shown in FIG. 7.

As described above, the exposure apparatus according to the present embodiment includes a plurality of light sources that emit a light beam, a detection unit that detects light beams emitted from the plurality of light sources, and a plurality of driving units that drive respectively differing light sources among the plurality of light sources. Each driving unit causes any one of the plurality of light sources to emit light, and executes light amount control in which control is performed based on a light amount of a light beam detected by the detection unit such that the light amount of the light beam emitted from that light source becomes a predetermined light amount. Each of the plurality of driving units does not execute light amount control of a light source to be driven when another driving unit is causing the light source to be driven to emit light, and executes light amount control of the light source to be driven when another driving unit is not causing the light source to be driven to emit light. Thus, the exposure apparatus according to the present embodiment is able to reduce the frequency of occurrence of an unintended combination of control states, such as mutual APC control being performed simultaneously due to mixing in of noise or the like. The present embodiment is also applicable to an image forming apparatus provided with the above exposure apparatus.

Second Embodiment

Figure 11:
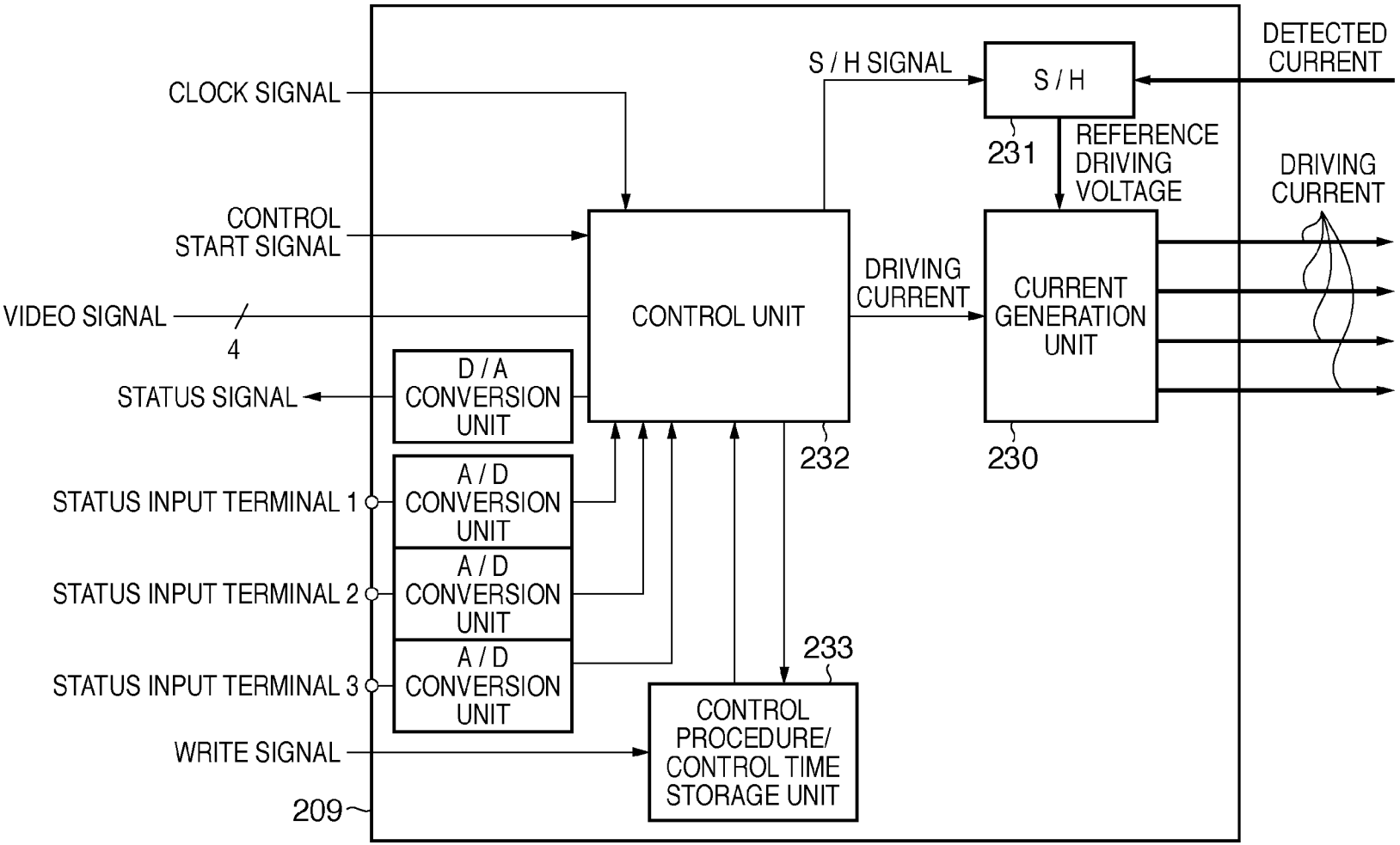
FIG. 11 shows an example of an internal circuit of a laser control apparatus 209 provided with three status input terminals according to a second embodiment.
Figure 12:
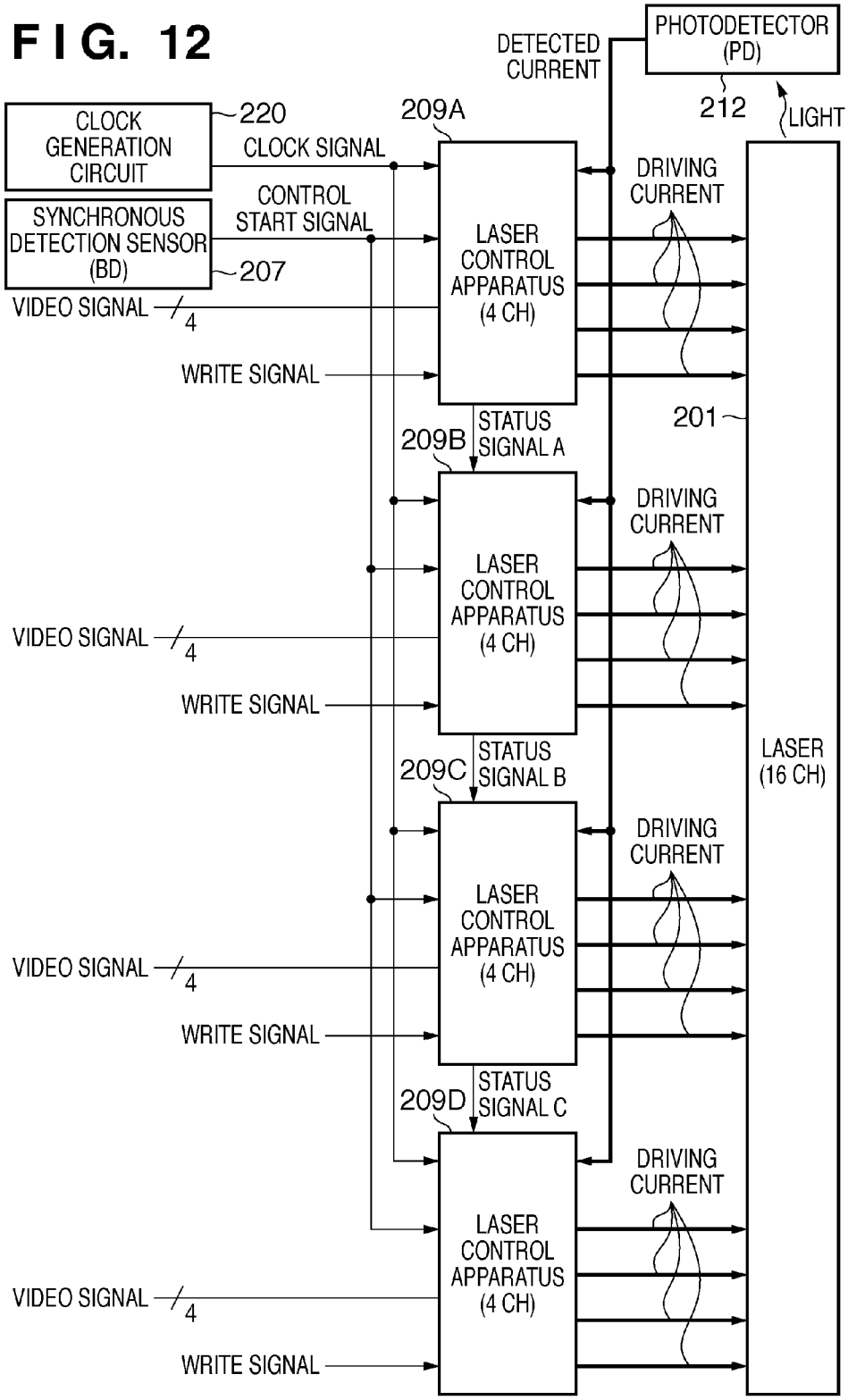
FIG. 12 shows an example configuration in which four laser control apparatuses have been connected in a cascading manner according to the second embodiment.

Next is a description of a second embodiment, with reference to FIGS. 11 and 12. In the first embodiment, a description was given of a case of controlling a laser light source 201 provided with eight light sources using two laser control apparatuses, but in the present embodiment, a description is given of a case of controlling a laser light source 201 provided with sixteen light sources using four laser control apparatuses.

When using four laser control apparatuses, it is necessary for a laser control apparatus to monitor status signals of the other three laser control apparatuses. Therefore, by providing the laser control apparatus with three status input terminals (status input terminals 1 to 3) as shown in FIG. 11, similar effects as in the case of using two laser control apparatuses are obtained.

Alternatively, as shown in FIG. 12, four laser control apparatuses (laser control apparatuses 209A to 209D) may be connected in a cascading manner. With this configuration, when the laser control apparatus 209A has finished one sequence of the APC control, the laser control apparatus 209B starts one sequence of the APC control. Furthermore, when the laser control apparatus 209B has finished one sequence of the APC control, the laser control apparatus 209C starts one sequence of the APC control, and when the laser control apparatus 209C has finished one sequence of the APC control, the laser control apparatus 209D starts one sequence of the APC control. When using this configuration, it is not necessary to increase the number of status input terminals provided in the laser control apparatus, so it is possible to suppress an increase in the circuit size of the laser control apparatus.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-017250 filed on Jan. 28, 2010 and No. 2011-006348 filed on Jan. 14, 2011, which are hereby incorporated by reference herein in their entirety.

What is claimed is:

1. An exposure apparatus, comprising:

a plurality of light sources that emit a light beam;

a detection unit that detects light beams emitted from the plurality of light sources;

a clock signal generation unit that generates a clock signal;

a plurality of driving units each of which respectively drives, among the plurality of light sources, light sources different from each other, and each of which executes a light amount control based on a detection result by the detection unit, causes, in the light amount control, the driven light source to emit the light beams at different timings from each other based on the clock signal input by the clock signal generation unit, outputs a state signal indicating a state of the light amount control, and receives the state signal output by another driving unit;

a determination unit disposed to each of the plurality of driving units and configured to determine whether or not an other driving unit is causing the light source to emit light to execute the light amount control based on the received state signal of the other driving unit, wherein each of the plurality of driving units does not cause the driven light source to emit the light beam when another driving unit is causing the light source to emit the light beam to execute the light amount control.

2. The exposure apparatus according to claim 1:

wherein each driving unit comprises a storage unit that stores a control procedure of the plurality of light sources, and is configured:

to execute the light amount control of each light source according to the control procedure that has been stored in the storage unit.

3. The exposure apparatus according to claim 2, wherein the storage unit, in addition to the control procedure, further stores execution time information that indicates a control time of each control in the control procedure.

4. An image forming apparatus, comprising:

the exposure apparatus according to claim 1.

* * * * *